US009734844B2

(12) United States Patent
Kim et al.

(10) Patent No.: US 9,734,844 B2
(45) Date of Patent: Aug. 15, 2017

(54) IRREGULARITY DETECTION IN MUSIC

(71) Applicant: Adobe Systems Incorporated, San Jose, CA (US)

(72) Inventors: Minje Kim, Savoy, IL (US); Gautham Mysore, San Francisco, CA (US); Peter Merrill, Sunnyvale, CA (US); Paris Smaragdis, Urbana, IL (US)

(73) Assignee: Adobe Systems Incorporated, San Jose, CA (US)

( * ) Notice: Subject to any disclaimer, the term of this patent is extended or adjusted under 35 U.S.C. 154(b) by 0 days.

(21) Appl. No.: 14/948,595

(22) Filed: Nov. 23, 2015

(65) Prior Publication Data

US 2017/0148468 A1 May 25, 2017

(51) Int. Cl.

| | |
|---|---|
| ***A63H 5/00*** | (2006.01) |
| ***G04B 13/00*** | (2006.01) |
| ***G10H 7/00*** | (2006.01) |
| ***G10L 25/57*** | (2013.01) |
| ***G10L 21/0232*** | (2013.01) |

(52) U.S. Cl.

CPC ..... *G10L 25/57* (2013.01); *G10L 21/0232* (2013.01); *G10H 2210/076* (2013.01); *G10H 2250/235* (2013.01)

(58) Field of Classification Search

CPC ..... G10L 25/57; G10L 21/0232; G10H 2210/076; G10H 2250/235

USPC ..... 84/609

See application file for complete search history.

(56) References Cited

U.S. PATENT DOCUMENTS

| | | | | |
|---|---|---|---|---|
| 9,514,722 | B1 * | 12/2016 | Kim | G10H 1/0008 |
| 2004/0181397 | A1 * | 9/2004 | Gao | G10L 19/005 704/207 |
| 2008/0281589 | A1 * | 11/2008 | Wang | G10L 21/0208 704/226 |
| 2013/0064379 | A1 * | 3/2013 | Pardo | H04S 7/40 381/56 |
| 2016/0267920 | A1 * | 9/2016 | Sugano | G10L 25/84 |

* cited by examiner

*Primary Examiner* — Jeffrey Donels

(74) *Attorney, Agent, or Firm* — Shook, Hardy & Bacon, L.L.P.

(57) ABSTRACT

Embodiments of the present invention relate to detecting irregularities in audio, such as music. An input signal corresponding to an audio stream is received. The input signal is transformed from a time domain into a frequency domain to generate a plurality of frames that each comprises frequency information for a portion of the input signal. An irregular event in a portion of the input signal corresponding to a set of frames in the plurality of frames is identified based on a comparison of frequency information of the set of frames to the frequency information of other sets of frames of the plurality of frames. This allows an indication of the irregular event to be provided, or for the input signal to be automatically synchronized to a multimedia event.

20 Claims, 6 Drawing Sheets

IRREGULARITY DETECTION IN MUSIC

BACKGROUND

When analyzing audio streams, a common technique is to identify periodically repeating events, which is an event that occurs multiple times or that occurs regularly in an audio stream. There are many types of audio streams that could be analyzed, including music, a goal of a soccer game, a home run in a baseball game, an explosion in a movie, etc. For music specifically, a downbeat, the first beat of every measure or bar in music, is one example of a repeating event. Downbeats are usually distanced apart from each other by a few seconds. Identifying downbeats and other regularly occurring events in an audio stream, while useful for some applications, may not be an effective way to match music to a multimedia experience, such as a video or slide show of images, as the downbeats often occur regularly and frequently.

SUMMARY

Embodiments of the present invention are directed to methods and systems for detecting irregularities in music. For instance, when using music or some other audio to enhance a multimedia experience, it is useful to be able to automatically detect the striking and distinct parts of a song, as that information can be used to match the music to the multimedia, such as a video, images, etc. A slide show, for example, could be set to music, and it may be desirable to have the audio correspond to the images in the slide show. Accordingly, embodiments are directed to automatically detecting these irregular parts of audio. In operation, such irregular parts of audio are detected by comparing frequency information of frames or groups of frames to other frames or groups of frames. In embodiments, a frequency structure, such as spectrogram, is generated from an audio signal. In some implementations, the unwanted noise floor can be removed from the constructed matrix to generate a residual matrix, which improves the detection of irregularities of the audio stream. From the matrix, sparsity can be measured for each of the column vectors in the matrix. One example of a sparsity measurement is entropy, which indicates a level of randomness. Once computed, the column vectors having the lowest entropies are automatically identified as having the highest levels of irregularity.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

The present invention is described in detail below with reference to the attached drawing figures, wherein.

DETAILED DESCRIPTION

Figure 1:
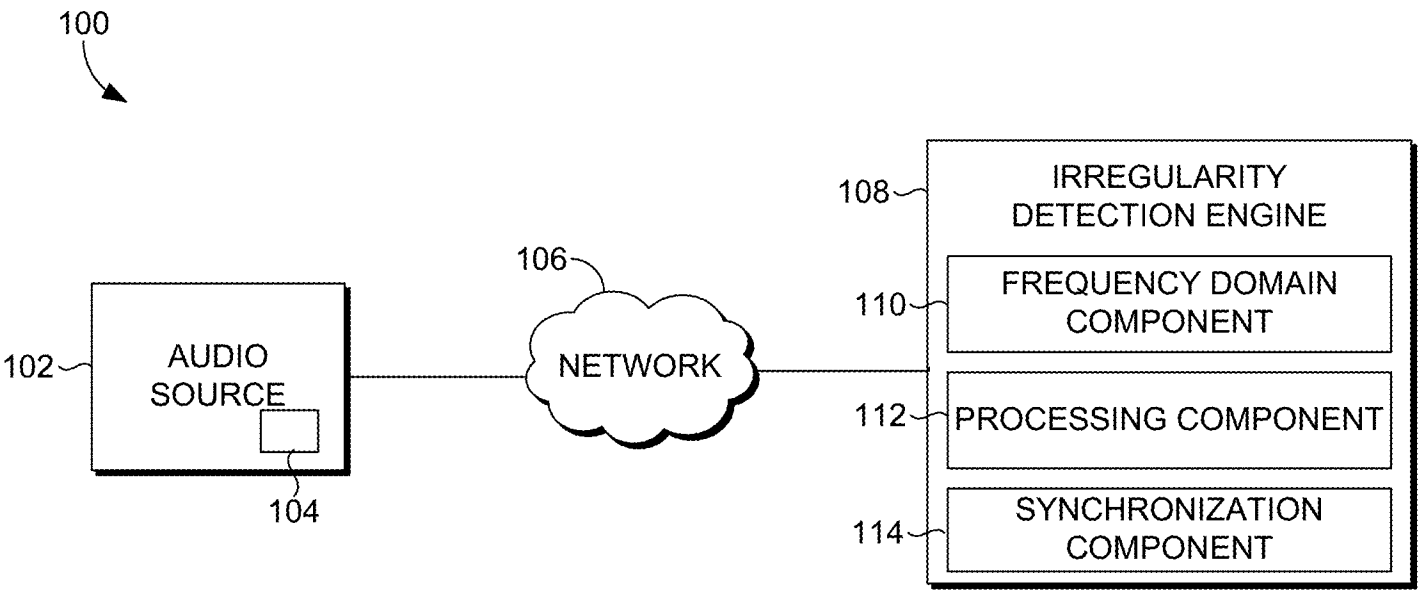
FIG. 1 is a block diagram of an exemplary computing system suitable for use in implementing embodiments of the present invention.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Conventional systems that analyze audio, and in particular music, identify periodically repeating events that occur throughout the music stream. For instance, a downbeat is an example of a periodically repeating event. A downbeat is the first beat of every measure or bar of a music stream. While this analysis may be useful in some specific scenarios, it is not effective to be able to use music to enhance a multimedia experience due to downbeats occurring too frequently in the music. For example, if an image in a slide show were to change each time a new downbeat occurred, the image would change every 2 seconds or so, depending on the specific type of music being analyzed.

Instead of using periodically repeating events to enhance a multimedia experience with music, such as setting a slide show of images or a video to music, embodiments of the present invention analyze a music stream, and in particular a signal of the music stream, to identify irregularities in the music. When there is a loud drum crash or another irregular event that is perhaps loud, unusual in the music stream, or different (e.g., uses a different instrument than is present in other portions of the music stream), this irregular event is identified so that it can be matched up with an exciting or otherwise different portion of a slide show or video to which the music is being set. In scenarios where there is an exciting portion of a slide show or video, it is desirable to have that exciting portion match up with an exciting-sounding portion of the music. However, this is difficult to ascertain when only periodically repeating events are identified from the music.

As such, embodiments provided herein are directed to methods and systems for facilitating detection of irregularities in an audio signal. An audio signal can correspond to any type of audio, including music. In some instances, it may be desirable to determine the loud, different, or otherwise important portions of music so that a slide show of images, a video, etc., can be set to the music. An exciting part of a video, for example, may be desired to be displayed at a time in the music when an exciting part occurs, which could be a loud percussion sound that is not found in other portions of the music, for example.

In operation, once an audio signal is received, the audio signal is transformed into a frequency structure, also termed a spectrogram. A frequency structure, as used herein, is a visual representation of a spectrum of frequencies of the input signal. Time-frequency transform is a common technique used in audio processing to convert time to a frequency domain. This transformation is performed to obtain underlying information from the audio signal that could not otherwise be ascertained from the audio signal itself. In some embodiments, a Fourier transform, such as a short-time Fourier transform, is used to obtain a frequency structure of the audio signal. When a short-time Fourier transform is used, short periods of the audio signal are analyzed individually, each forming a column vector once transformed.

Some types of music have both rhythmic events and harmonic events. In one aspect provided herein, harmonic structures of the frequency structure are suppressed while leaving the percussive structure. Media filtering is one way of suppressing the harmonic structures, such as applying media filtering along the vertical axis. Another way of suppressing the harmonic structures is to subtract a value of a first column vector from a subsequent and consecutive second column vector. If there isn't much difference, such as if the resulting value is close to zero, this indicates that nothing is changing much between the two periods of time. However, if there is a percussive instrument represented in a first column vector but not in the second column vector, the difference may be significant.

From the frequency structure, whether or not the harmonic structure has been suppressed or removed, a matrix is generated. There are several ways that a matrix can be generated from a frequency structure. In one aspect, single column vectors are compared. In another aspect, groups of column vectors are compared. While irregularities can be detected from this type of matrix, a residual matrix may be generated to reduce or remove the noise floor, as the noise floor may smear the matrix by adding unwanted near-constant noise. To remove this unwanted noise floor, a deflation Non-Negative Matrix Factorization (NMF) may be used to decompose an input non-negative matrix into a lower-rank approximation and a sparse residual. This residual matrix can then be analyzed to identify irregularities.

The identification of irregularities can be done in several ways. To measure sparsity in column vectors from the matrix, a measurement, such as entropy, is used. Entropy represents a level of randomness in a column vector. As such, the entropy of each column vector is computed. Those column vectors having the lowest entropies have the most irregularity, or are the sparsest, while those having the highest entropies have the most similarities to other column vectors.

Having briefly described an overview of embodiments of the present invention, an exemplary operating environment in which embodiments of the present invention may be implemented is described below in order to provide a general context for various aspects of the present invention. Referring initially to FIG. 1 in particular, an exemplary operating environment for implementing embodiments of the present invention is shown and designated generally as environment 100.

The environment 100 of FIG. 1 includes an audio source 102 having an audio signal 104, and an irregularity detection engine 108. Each of the audio source 102 and the irregularity detection engine 108 may be, or include, any type of computing device (or portion thereof) such as computing device 700 described with reference to FIG. 7, for example. The components may communicate with each other via a network 106, which may include, without limitation, one or more local area networks (LANs) and/or wide area networks (WANs). Such networking environments are commonplace in offices, enterprise-wide computer networks, intranets, and the Internet. It should be understood that any number of audio sources and irregularity detection engine (or components thereof), may be employed within the environment 100 within the scope of the present invention. Each may comprise a single device or multiple devices cooperating in a distributed environment. For instance, the irregularity detection engine 108 may be provided via multiple devices arranged in a distributed environment that collectively provide the functionality described herein. Additionally, other components not shown may also be included within the environment 100, while components shown in FIG. 1 may be omitted in some embodiments.

The audio source 102 may be any type of computing device owned and/or operated by a user, company, agency, or any other entity capable of accessing network 106. For instance, the audio source 102 may be a desktop computer, a laptop computer, a tablet computer, a mobile device, or any other device having network access. Generally, a user or other entity may employ the audio source 102 to, among other things, create and/or store one or more audio streams, represented by item 104. For example, the user may employ a web browser on the audio source 102 to upload or otherwise transmit an audio stream to the irregularity detection engine 108. In embodiments, a user or other entity of the audio source 102 desires to create or enhance a multimedia experience, such as to create a photo slide show set to music, or to set a video to music. In an embodiment, the audio source 102 is a computer associated with a user who wants to create such a photo slide show, video, etc. set to music, but in other embodiments, the audio source 102 is a device associated with the irregularity detection engine 108 and acts as a source for audio streams. As such, a user wanting to create a photo slide show, video, etc. set to music may or may not provide the music stream to the irregularity detection engine 108.

The irregularity detection engine 108 comprises various components, including a frequency domain component 110, a processing component 112, and a synchronization component 114. While these three components are illustrated in FIG. 1 and described with specificity herein, the irregularity detection engine 108 could have more or less components than these three. For instance, the functionality of two components may be combined into a single component, or could be divided into more than two individual components. As such, these three components are described herein for exemplary purposes only to describe the functionality of the irregularity detection engine 108.

The frequency domain component 110 is configured to transform at least a portion of an input signal corresponding to an audio stream from a time domain into a frequency domain. In embodiments, a plurality of frames are produced by the frequency domain component 110, where each of these frames comprises frequency information associated with the period of time, or moment of music, corresponding to the respective frame or set of frames. In some embodiments, the frequency domain component 110 is also configured to generate a frequency structure from frequency information associated with the input signal. A frequency structure may be generated to obtain underlying data from the audio signal that could not be obtained using just a 1D audio signal itself. As used herein, a frequency structure refers to a spectrogram that is generated from an audio signal corresponding to an audio stream, where a time period of a signal is converted into the frequency domain. A frequency structure is comprised of a plurality of column vectors.

There are many ways that this transformation from the time domain to the frequency domain can be done. One exemplary way is a time-frequency transform, which can be used to convert a 1D signal into a matrix when audio (e.g., music) is analyzed. In some embodiments herein, multiple short-time periods of a signal are converted into a frequency domain, instead of the entire signal at one time. For example, a short period of an audio signal may be used for each computed column vector. As used herein, a column vector refers to a single column of one or more elements in a matrix, such as a spectrogram. The coefficients of such short-time periods represent the contribution of the frequency bands in that short excerpt of the input signal. Each conversion results in a column vector of those frequency coefficients. The column vectors for each short-time period from the start to the end of the input signal are assembled to construct a sequence of column vectors. A Fourier transform, and in particular a short-time Fourier transform, can be used for this conversion of an input signal into a sequence of column vectors. A short-time Fourier transform is used to determine the sinusoidal frequency and phase content of local sections of a signal as it changes over time. Typically, a longer time signal is divided into shorter segments of equal length and the Fourier transform is computed separately on each shorter segment. The changing spectra can then be plotted as a function of times.

Figure 2:
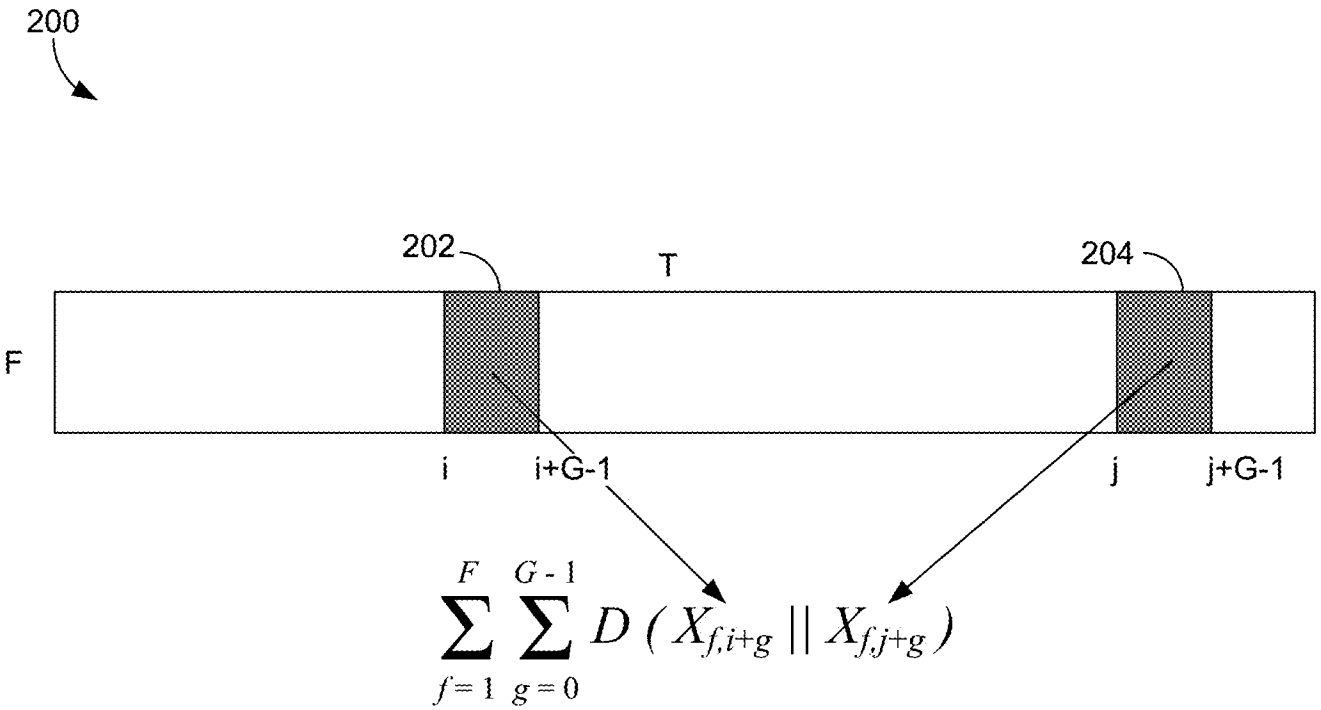
FIG. 2 is a spectrogram generated from an input signal and a procedure of calculating an element of a Self-Similarity Matrix (SSM), in accordance with embodiments of the present invention.

In one aspect, a Constant Q Transform is used when the audio is music, as it is particularly useful for analyzing this type of audio. A Constant Q Transform transforms a data series to the frequency domain, and is related to the Fourier transform. In embodiments herein, the frequency structure generated by the frequency structure generation component 110 is also called a spectrogram. An exemplary spectrogram is illustrated in FIG. 2 here, and will be discussed in more detail below.

In some embodiments, harmonic structure may be removed or at least suppressed from the frequency information or from the frequency structure, if a frequency structure has been generated, while leaving percussive structure, such as the drums. Depending on the type of music or other audio represented by the audio signal that is being processed, this step of suppressing or removing harmonic structure from the frequency information and/or spectrogram may or may not be performed. For instance, for some music with percussive instruments, an explicit boosting of rhythmic music sources can help identify rhythmic events. There are several ways to do this. A first option of removing harmonic structure from the spectrogram is to compare individual column vectors. For example, for a column vector i and a column vector i−1, the difference between the two is computed (e.g., (i−1)−i). If the difference is very small, such as close to zero, that indicates that there isn't much or any change between the two column vectors, and as such the short-time period of the audio signal is represented by the column vectors. One example of when the difference between two column vectors is small or close to zero is when there is a steady violin playing throughout both portions of the audio signal represented by the two column vectors. One example of when the difference between two column vectors is large is when there is a percussive instrument in column vector i but not in i−1, or vice versa. In this first option, a similar computation is computed for each pair of adjacent column vectors.

A second option in removing harmonic structure from a spectrogram is to use median filtering of a harmonic signal along the vertical axis of the spectrogram. Here, a median of the values of a part of the harmonic spectrum is computed. All values of that part are replaced with the median, and the filtering procedure is repeated for the other possibly overlapped parts of the spectrum along the vertical axis such that the harmonic peaks are removed. This method is useful because harmonic peaks are far from the median of a given choice of vertically adjacent coefficients. Also, this method may be most effective when percussive instruments are present in the music.

The processing component 112 is configured to process the input signal to ultimately determine where, in the input signal, an irregular event may occur. In some embodiments, the processing component 112 is configured to determine, for a set of frames, the regularity of expression of the frequency information compared to other sets of frames. The processing component 112 is also configured to determine, from the comparing step of the sets of frames described above, that the frequency information in the set of frames indicates that a portion of the audio signal corresponding to the set of frames comprises an irregular event. For instance, if certain frequency information in a set of frames occurs regularly in other sets of frames, the set of frames may not include an irregular event. However, if certain frequency information in the set of frames does not occur regularly in other sets of frames, such as it that frequency information occurs only in the set of frames, it may be determined that an irregular event occurs in that set of frames.

In some embodiments, the processing component 112 may also be configured to generate a matrix out of the magnitude spectrogram, the logarithm of the magnitudes, or any exponentiation of the magnitudes. In some cases, a matrix may not be generated. However, if it is generated, the follow description applies. The rhythmic portion of the spectrogram is used if the spectrogram underwent the rhythm source boosting block, as described above. In one embodiment, the matrix generated is an SSM. While there are other matrices that may be used in embodiments other than an SSM, an SSM will be used throughout this disclosure to more fully describe aspects herein. As used herein, an SSM is a graphical representation of similar sequences in a data series (input signal). Similarity can be shown by different measurements, such as spatial distance (distance matrix), correlation, etc. Generally, to construct an SSM, a data series is transformed into an ordered sequence of feature vectors, where each vector describes relevant features of a data series in a given local interval. Then, the SSM is formed by computing the similarity of pairs of feature vectors. An SSM can use different measurements, such as spatial distance (distance matrix), correlation, etc.

One example of computing the similarity of pairs of feature vectors is provided by FIG. 2. FIG. 2 herein illustrates a spectrogram generated from an input signal, and the calculation of an SSM element from the spectrogram. Items 202 and 204 represent groups of column vectors. For example, item 202 is a group that includes column vectors i through (i+G−1), where item 204 is a group that includes column vectors j through (j+G−1). The equation illustrated in FIG. 2 and reproduced below is a comparison of these two groups of column vectors and may be used to construct the SSM using distance. "F" represents the number of frequency bands, and "G" is the number of frames to be compared.

$$D_{1j} = \sum_{f=1}^{F} \sum_{g=0}^{G-1} \mathcal{D}(X_{f,i} \| X_{fj+g}) \quad \text{Equation (1)}$$

As there are T frames (or groups of frames) in total, a distance matrix is a (T−G+1)×(T−G+1) symmetric matrix. Having "G" in this equation is helpful when the length of an event is longer than a frame (e.g., a few seconds) so that an element represents the distance between the two events starting from the i-th frame and j-th frame, respectively. Since function D can be any distance metric, such as cosine or Euclidean distance, the matrix D is a pairwise distance matrix. A conversion from the distance matrix to a similarity matrix can be performed by an element-wise inversion, such as $S_{i,j}=1/D_{i,j}$. Diagonal elements are trivial, as they do not include meaningful information. The elements near the diagonal may be ignored and can be replaced with the highest distance in the D matrix, and then inverted to construct S, whose near-diagonal elements become small values.

Figure 3B:
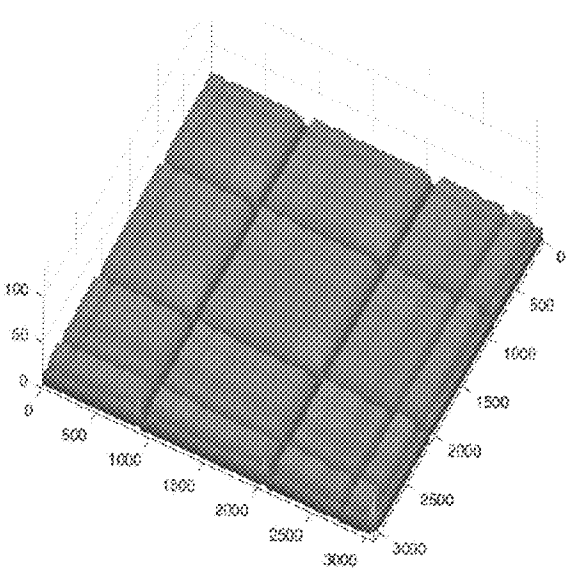
FIG. 3B is a recovered lower-rank approximation of the SSM of FIG. 3A, in accordance with an embodiment of the present invention.
Figure 3C:
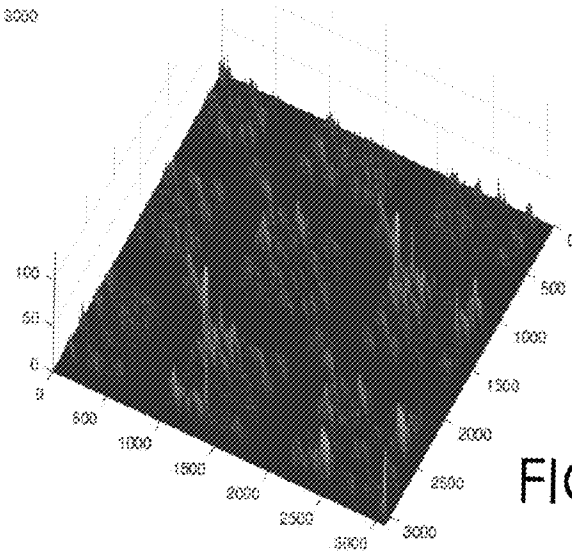
FIG. 3C is a residual SSM of FIG. 3B, in accordance with an embodiment of the present invention.
Figure 3A:
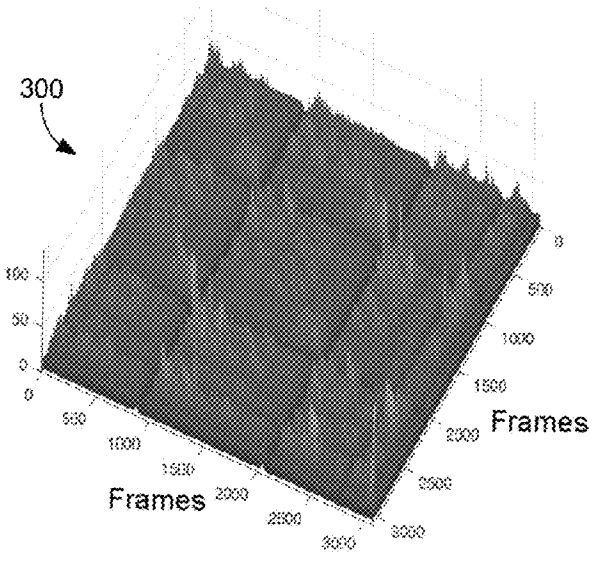
FIG. 3A is a SSM constructed from the spectrogram of FIG. 2, in accordance with an embodiment of the present invention.

An exemplary SSM is illustrated in FIGS. 3A-C, and will be discussed in more detail below. Generally, the matrix may be a T by T matrix, where T is the total number of frames, if the comparison is a pairwise distance of all the different spectra. The i,j element, for instance, represents the difference between the i and j frames in the original spectrogram. There are different ways of computing the SSM from a spectrogram. In one aspect, single frames are compared. This is the simplest method of making this computation, but it may not be as accurate as other methods. An alternative method is to compare groups of frames to other groups of frames. FIG. 2 illustrates this method of comparing groups of frames. This method may be more accurate, and thus more likely to be used in some instances, such as if a frame is relatively long, such as two seconds, three seconds, four seconds, etc. After the above-described computation, the SSM can be constructed, such as the SSM illustrated in FIG. 3A.

In some embodiments, the processing component 112 is configured to reduce or remove the noise floor from the SSM, which may allow an optimized identification of any irregularities in an audio stream. In embodiments, a deflation NMF is utilized. Here, it may be assumed that an input nonnegative matrix can be decomposed into a lower-rank approximation and a sparse residual, which are all nonnegative. The following formula may be used:

$$S \approx WH + R \quad \text{Equation (2)}$$

In the above formula, W and H are the basis vectors and their encodings for the lower-rank approximation part. R is the residual. It should be noted that all of W, H, and R are non-negative. In this deflation method, the lower-rank approximation tends to represent the most important components of the matrix, while the residual part holds some less important details in terms of reconstructing the input. Here, this technique may be applied to the SSM matrix to reduce any unwanted noise floor in the SSM. FIG. 3A depicts an exemplary SSM having a set of diagonally aligned peaks sitting on top of a block-structured noise floor. To detect irregularities, the sparsity of all of the column (or row) vectors is analyzed. However, as shown in FIG. 3A, the noise floor can smear the SSM by adding up some unwanted near-constant noise. As such, a method, as previously described, may be used to separate the noise floor. The lower-rank approximation part WH in FIG. 3B illustrates that the noise floor consumes the most energy of the given input S, and because of this, the noise floor may be extracted out of the S of the above equation. FIG. 3B is an exemplary recovered lower-rank approximation of the SSM of FIG. 3A, and as mentioned above, is to be extracted out from the SSM of FIG. 3A. FIG. 3C is a residual SSM of FIG. 3B, and illustrates the SSM without the noise floor, as the effect of the noise floor has been mitigated through this decomposition.

Even further, the processing component 112 may be configured to identify, from the column vectors, whether or not in an SSM on not (whether or not the noise floor has been removed), the sparsely active column vectors that represent a period of time in the audio stream having irregularities compared to other column vectors. A number of methods may be used to identify the column vectors that are sparsely active, such that they rarely occur within the other column vectors. An exemplary method for measuring or otherwise computing sparsity is shown below, where entropy is used as the method to compute sparsity. As used herein, entropy refers to the level of randomness in a particular column vector.

$$\mathcal{H}(R_{i,j}) = -\sum_{j} R_{i,j} \log R_{i,j} \quad \text{Equation (3)}$$

In the above equation the i-th column vector of the residual matrix R, described above, shows the level of similarity between the i-th pattern (which is a set of G adjacent frames starting from the i-th frame) and all the other patterns. Therefore, if the i-th column has a small number of peaks, it means that the i-th pattern appears a few times. Likewise, sparseness of column vectors can illustrate the irregularity of events. Specifically, in the above equation, $R_i$: is the i-th column vector. In some embodiments, R may be normalized so that $\Sigma_j R_{i,j}=1$. If the entropy of the i-th column is lower than the others, this indicates that the i-th pattern appears rarely across the audio stream. This frame-wise measurement, thus, can be used to determine the level of irregularity in a particular portion of the audio stream. Average filtering could optionally be used to smooth out the frame-wise entropy measurements. Alternatively, a non-minimum suppression technique may be used to enumerate the most noticeable or important irregular events to identify the peaks of the entropy function over time.

In some types of audio, such as music, the computed entropies for many of the column vectors will be high (e.g., not close to zero), indicating that the column vector is similar to others, and thus likely does not have any irregularities that are noticeable or important. As mentioned, entropy refers to the level of randomness of a column vector. As such, if a particular column vector possesses randomness of the underlying audio, the entropy will be low, or even close to zero. However, if a column vector has a similar structure to other column vectors, the entropy will be high. Once entropies have been computed for all column vectors, the column vectors are identified that have lower entropies, as those are the ones that likely have irregularities.

Once the column vectors having the lowest entropies are identified, the portions of the music stream corresponding to those column vectors can be identified. This allows the music to be matched up or aligned to some type of multimedia event, such as, for example, a slide show of images or a video. In some embodiments, the irregularity detection engine 108 aligns the music to a multimedia event based on the identified irregularities in the music and may send the finished product to a user device, such as the audio source 102. In other embodiments, once the irregularities are determined, a file comprising an indication of the portions of the music that have irregularities may be communicated to the audio source 102, where some type of sound/image/video editing software may be used to align the multimedia event with the music.

The synchronization component 114 is configured to automatically synchronize an input signal to a multimedia event (e.g., video, slideshow of images) based on the identification of an irregular event, such as by the processing component 112. As mentioned, one exemplary purpose of identifying that an irregular event occurs in music (e.g., a portion of the music that is loud compared to the other portions) and where that irregular event occurs is so that the music can be synchronized with a multimedia event, such as a video, for instance. In embodiments, the irregularity detection engine 108 has the capability to automatically match up or synchronize the music with the multimedia event, which could be done at the request of a user.

In other embodiments where the system may not automatically synchronize the music or input signal to a multimedia event, the irregularity detection engine 108 may be configured to modify an electronic record that corresponds to the input signal to identify that the portion of the input signal corresponding to the set of frames comprises the irregular event. As such, once the song associated with the input signal is needed for some other process, such as to match the song with a multimedia event, the electronic record corresponding to the input signal will have stored therein an indication as to the presence of an irregular event, and could even have stored a description of the irregular event. As used herein, an electronic record is information recorded by a computer that is produced or received in the initiation, conduct or completion of an activity.

There are several advantages of using the described system above to identify irregularities in an audio stream. The unsupervised nature of the proposed system can flexibly adapt to unseen signals. Additionally, the sparsity measurement (e.g., entropy) based irregularity measurement can provide the system with the saliency level of a given event. In some embodiments, the system described herein for detecting irregularities could be used along with a system for tracking regular events, which could reduce any false positives by ignoring spurious candidates that do not fall in the category of the music ornamentation. Additionally, when the decomposition technique, as described above, is used, the effect of the noise floor is decreased so that entropy-based detection can focus on the repetition structure. The system having the capability to use the harmonic structure removal algorithms as described herein is also an advantage, especially when the signal comprises both harmonic and percussive instruments playing at the same time.

It should be understood that this and other arrangements described herein are set forth only as examples. Other arrangements and elements (e.g., machines, interfaces, functions, orders, and groupings of functions, etc.) can be used in addition to or instead of those shown, and some elements may be omitted altogether. Further, many of the elements described herein are functional entities that may be implemented as discrete or distributed components or in conjunction with other components, and in any suitable combination and location. Various functions described herein as being performed by one or more entities may be carried out by hardware, firmware, and/or software. For instance, various functions may be carried out by a processor executing instructions stored in memory.

The components illustrated in FIG. 1 are exemplary in nature and in number and should not be construed as limiting. Any number of components may be employed to achieve the desired functionality within the scope of embodiments hereof. For example, any number of audio sources or irregularity detection engines may exist. Further, components may be located on any number of servers, computing devices, or the like. By way of example only, the irregularity detection engine 108 might reside on a server, cluster of servers, or a computing device remote from or integrated with one or more of the remaining components.

Figure 4:
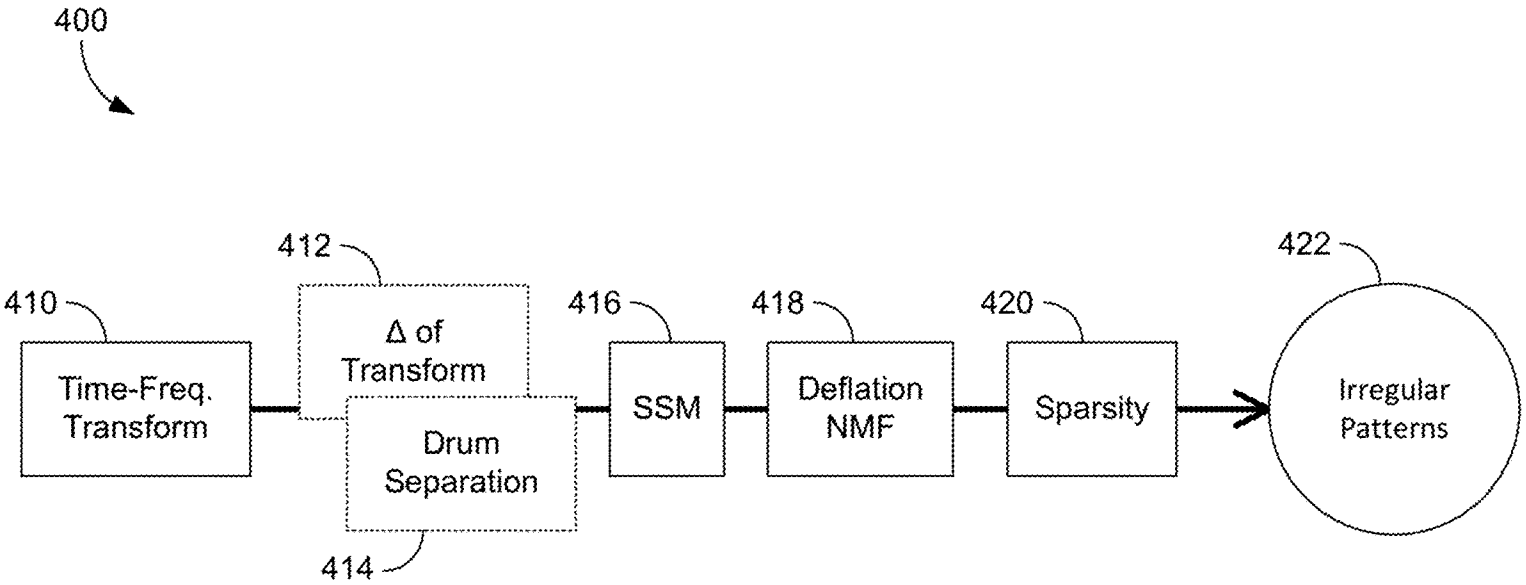
FIG. 4 is a flow diagram of a system for detecting irregularities in audio, in accordance with an embodiment of the present invention.

Turning now to FIG. 4, a high-level flow diagram 400 is provided of a system for detecting irregularities in audio, in accordance with an embodiment of the present invention. The flow diagram generally follows the description of the various components of the irregularity detection engine 108 described in relation to FIG. 1 herein. The flow diagram 400 of FIG. 4 comprises a time-frequency transform 410, a determination of the change of the transform 412 and an optional drum separation 414, generating an SSM 416, performing a deflation NMF 418, and computing the sparsity of column vectors 420, which leads to the detection of irregularity patterns 422.

Figure 5:
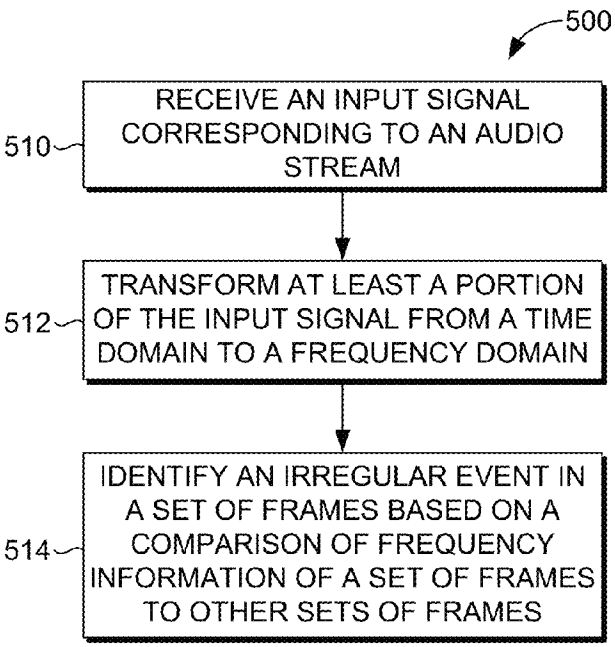
FIG. 5 is a flow diagram showing a method for detecting irregularities in audio, in accordance with an embodiment of the present invention.

FIG. 5 is a flow diagram showing an exemplary method 500 for detecting irregularities in audio. Initially, an input signal corresponding to an audio stream is received at block 510. In one aspect, the audio stream is music, and may include harmonic portions, rhythmic portions, or a combination. These harmonic and rhythmic portions may be included in different portions of the music, and thus not present throughout the audio stream. In one embodiment, the input signal is received by a user who would like to synchronize music to a multimedia event. In another embodiment, the input signal is received in the system by a data store that stores input signals for processing. At block 512, some or all of the input signal is transformed from a time domain into a frequency domain. As a result of the time-frequency transformation, a plurality of frames may be produced, where each frame or groups of frames comprise frequency information associated with a period of time, such as a moment of music. In embodiments, a frequency structure, such as a spectrogram, is generated.

As mentioned, there are several ways to transform a signal from the time domain to the frequency domain. In embodiments, a Fourier transform, such as a short-time Fourier transform, is utilized for this transformation. For example, the frequency domain component 110 described herein in reference to FIG. 1 may be utilized to make this transformation. At block 514, an irregular event in a portion of the input signal that corresponds to a set of frames is identified by, for instance, comparing frequency information for the set of frames to frequency information for other sets of frames in the plurality of frames. In one instance, a set of frames is a single frame or a group of frames. In some embodiments, a matrix is generated from the frequency structure. As described above in relation to FIG. 1, the processing component 112, may be used to generate the matrix. In one embodiment, the matrix is an SSM. If the spectrogram underwent the harmonic structure removal, as described above in relation to FIG. 1, the matrix may include only the rhythmic structure portion of the spectrogram.

In one embodiment, if a matrix has been generated, the noise floor may be removed from the matrix, thus generating a residual matrix. This may also eliminate the block structure of the matrix, which may improve the accuracy of the irregularity detection of the audio stream. For exemplary purposes only, a deflation NMF could be applied to the generated matrix to transform it into a residual matrix.

In some embodiments, a sparsely active column vector is identified that represents a period of time in the audio stream that has an irregularity compared to other column vectors. To identify the sparely active column vector, a sparsity computation may be performed, such as that described above in reference to FIG. 1. The sparsity computation determines the level of similarity between different column vectors. There are several ways to make this computation. For exemplary purposes only and not limitation, entropy could be used to measure sparsity of the column vectors. In this case, the sparsely active column vectors would have a lower entropy than other column vectors (e.g., because of the inverse nature of the computation), as lower entropies represent an occurrence of an irregularity in the audio stream within a period of time corresponding to the identified column vector having the lower entropy. Once the entropies of the column vectors have been computed, the column vectors with the lowest entropies can be identified as representing portions of the audio stream having irregularities. In one embodiment, each step at blocks 510, 512, and 514 is performed by a computing process performed by one or more processors.

Figure 6:
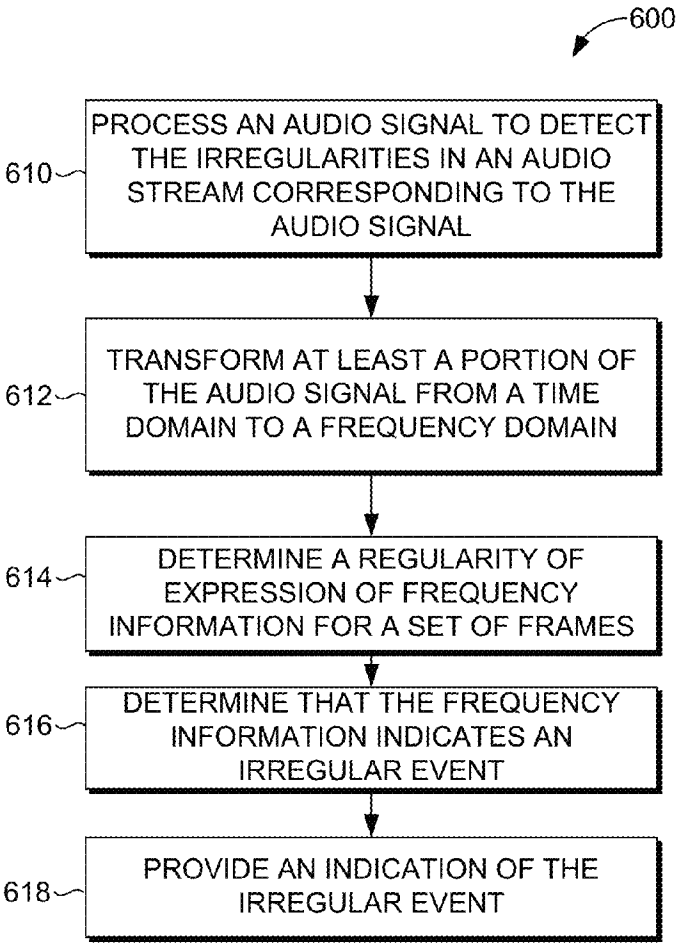
FIG. 6 is a flow diagram showing another method for detecting irregularities in audio, in accordance with an embodiment of the present invention.

Referring now to FIG. 6, a flow diagram is provided showing another exemplary method 600 for detecting irregularities in audio. At block 610, an audio signal is processed to detect the irregularities in an audio stream corresponding to the audio signal. At block 612, some or all of the audio signal is transformed into the frequency domain from the time domain. A plurality of frames may be produced from the transformation of the audio signal. In some embodiments, a frequency structure is generated that is represented as a spectrogram. This transformation may be done by, for instance, a time-frequency transform, such as a short-time Fourier transform. In one embodiment, the transformation is made by a Constant Q Transform. Prior to the frequency structure being transformed into a matrix, any harmonic structure present may be removed from the frequency structure to generate an altered spectrogram. The processing of the audio signal also includes determining a regularity of expression of frequency information for a particular frame or set of frames, shown at block 614. At block 616, it is determined that the frequency information indicates the occurrence of an irregular event in the set of frames being analyzed. At block 618, an indication is provided that the portion of the audio signal corresponding to the set of frames comprises the irregular event. While in one embodiment this indication is provided to a user (e.g., a user who has requested that the audio signal be synchronized to a multimedia event), in other embodiments, the indication may be provided to some type of data store or electronic record so that for future synchronizations, the presence and position of the irregular event in the audio signal can easily be retrieved.

Having described an overview of embodiments of the present invention, an exemplary computing environment in which some embodiments of the present invention may be implemented is described below in order to provide a general context for various aspects of the present invention.

Embodiments of the invention may be described in the general context of computer code or machine-useable instructions, including computer-executable instructions such as program modules, being executed by a computer or other machine, such as a personal data assistant or other hand-held device. Generally, program modules including routines, programs, objects, components, data structures, etc., refer to code that perform particular tasks or implement particular abstract data types. The invention may be practiced in a variety of system configurations, including hand-held devices, consumer electronics, general-purpose computers, more specialty computing devices, etc. The invention may also be practiced in distributed computing environments where tasks are performed by remote-processing devices that are linked through a communications network.

Figure 7:
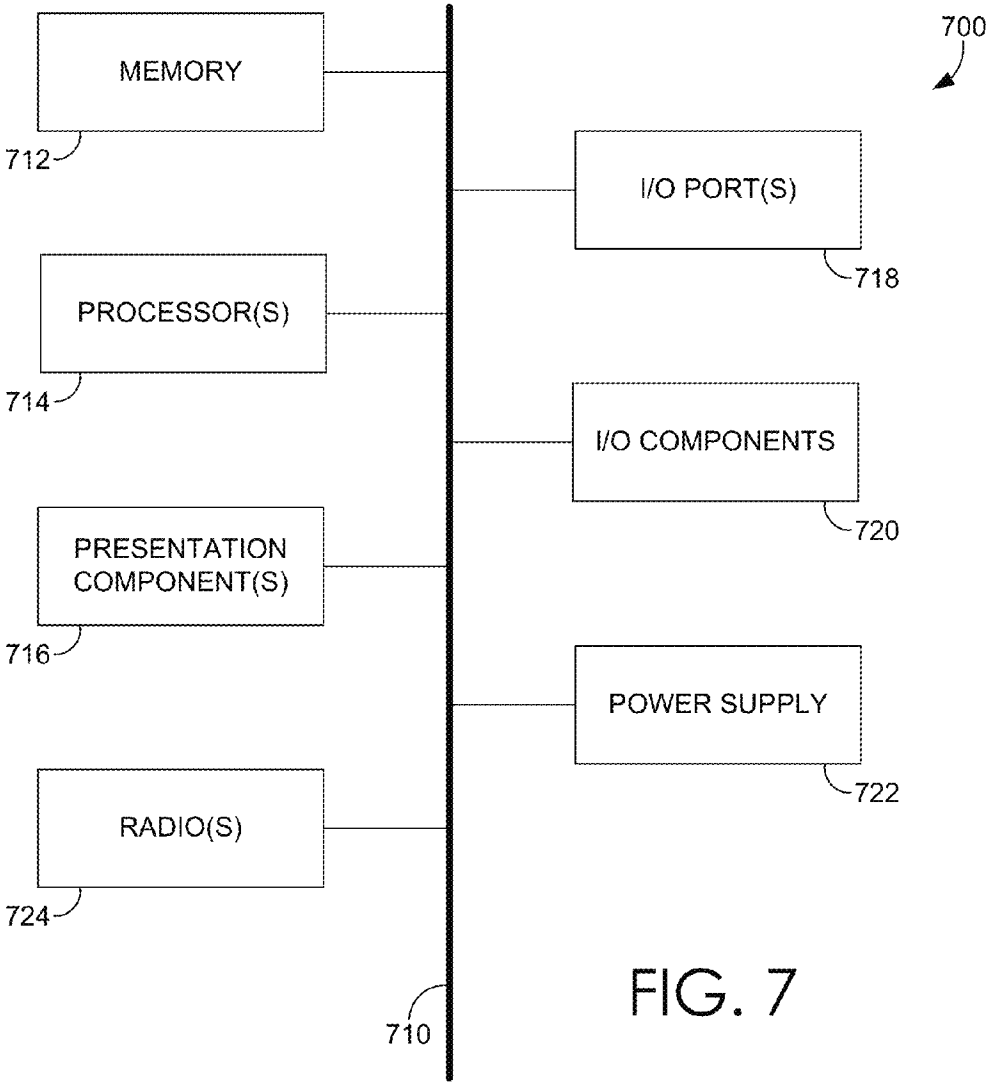
FIG. 7 is a block diagram of an exemplary computing environment in which embodiments of the invention may be employed.

Accordingly, referring generally to FIG. 7, an exemplary operating environment for implementing embodiments of the present invention is shown and designated generally as computing device 700. Computing device 700 is but one example of a suitable computing environment and is not intended to suggest any limitation as to the scope of use or functionality of the invention. Neither should the computing device 700 be interpreted as having any dependency or requirement relating to any one or combination of components illustrated.

With reference to FIG. 7, computing device 700 includes a bus 710 that directly or indirectly couples the following devices: memory 712, one or more processors 714, one or more presentation components 716, input/output (I/O) ports 718, input/output (I/O) components 720, and an illustrative power supply 722. Bus 710 represents what may be one or more busses (such as an address bus, data bus, or combination thereof). Although the various blocks of FIG. 7 are shown with lines for the sake of clarity, in reality, delineating various components is not so clear, and metaphorically, the lines would more accurately be grey and fuzzy. For example, one may consider a presentation component such as a display device to be an I/O component. Also, processors have memory. The inventors recognize that such is the nature of the art, and reiterate that the diagram of FIG. 7 is merely illustrative of an exemplary computing device that can be used in connection with one or more embodiments of the present invention. Distinction is not made between such categories as "workstation," "server," "laptop," "hand-held device," etc., as all are contemplated within the scope of FIG. 7 and reference to "computing device."

Computing device 700 typically includes a variety of computer-readable media. Computer-readable media can be any available media that can be accessed by computing device 700 and includes both volatile and nonvolatile media, removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computing device 700. Computer storage media does not comprise signals per se. Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer-readable media.

Memory 712 includes computer storage media in the form of volatile and/or nonvolatile memory. The memory may be removable, non-removable, or a combination thereof. Exemplary hardware devices include solid-state memory, hard drives, optical-disc drives, etc. Computing device 700 includes one or more processors that read data from various entities such as memory 712 or I/O components 720. Presentation component(s) 716 present data indications to a user or other device. Exemplary presentation components include a display device, speaker, printing component, vibrating component, etc.

I/O ports 718 allow computing device 700 to be logically coupled to other devices including I/O components 720, some of which may be built in. Illustrative components include a microphone, joystick, game pad, satellite dish, scanner, printer, wireless device, etc. The I/O components 720 may provide a natural user interface (NUI) that processes air gestures, voice, or other physiological inputs generated by a user. In some instance, inputs may be transmitted to an appropriate network element for further processing. An NUI may implement any combination of speech recognition, touch and stylus recognition, facial recognition, biometric recognition, gesture recognition both on screen and adjacent to the screen, air gestures, head and eye tracking, and touch recognition associated with displays on the computing device 700. The computing device 700 may be equipped with depth cameras, such as, stereoscopic camera systems, infrared camera systems, RGB camera systems, and combinations of these, for gesture detection and recognition. Additionally, the computing device 700 may be equipped with accelerometers or gyroscopes that enable detection of motion. The output of the accelerometers or gyroscopes may be provided to the display of the computing device 700 to render immersive augmented reality or virtual reality.

The present invention has been described in relation to particular embodiments, which are intended in all respects to be illustrative rather than restrictive. Alternative embodiments will become apparent to those of ordinary skill in the art to which the present invention pertains without departing from its scope.

What is claimed is:

1. A computer-implemented method for detecting irregularities in audio, the method comprising:

receiving, by a first computing process, an input signal corresponding to an audio stream;

transforming, by a second computing process, the input signal from a time domain into a frequency domain to generate a plurality of frames that each comprise frequency information for a respective portion of the input signal;

identifying, by a third computing process, an irregular event in a portion of the input signal that corresponds to a set of frames of the plurality of frames by comparing the frequency information of the set of frames to the frequency information of other sets of frames of the plurality of frames; and enabling a display of a multimedia event that is synchronized to the input signal based on the irregular event in the input signal, wherein the first, second, and third, computing processes are performed by one or more processors.

2. The method of claim 1, wherein the input signal is transformed from the time domain to the frequency domain using a short-time Fourier transform.

3. The method of claim 2, wherein a Self-Similarity Matrix (SSM) is used to compare the frequency information of the set of frames to the frequency information of other sets of frames.

4. The method of claim 1, further comprising generating a frequency structure from the frequency information in the plurality of frames, wherein the frequency structure is a spectrogram.

5. The method of claim 3, further comprising eliminating a block structure of the SSM prior to determining that the portion of the input signal corresponding to the set of frames comprises the irregular event.

6. The method of claim 1, further comprising automatically synchronizing the input signal to the multimedia event based on the irregular event in the input signal.

7. The method of claim 3, further comprising computing an entropy of one or more column vectors of the SSM to identify at least one column vector whose data indicates an occurrence of the irregular event.

8. The method of claim 7, wherein the at least one active column vector whose data indicates the occurrence of the irregular event has a lower entropy than others of the one or more column vectors.

9. The method of claim 8, wherein the lower entropy of the at least one column vector represents the occurrence of the irregularity in the audio stream in a period of time corresponding to the at least one column vector.

10. The method of claim 4, further comprising removing harmonic structure from the spectrogram to generate an altered spectrogram.

11. The method of claim 1, further comprising utilizing a deflation Nonnegative Matrix Factorization (NMF) to reduce unwanted noise floor from the frequency information.

12. One or more computer storage media storing computer-useable instructions that, when used by a computing device, cause the computing device to perform a method for detecting irregularities in audio, the method comprising:

processing an audio signal to detect the irregularities in an audio stream corresponding to the audio signal, the processing comprising:

transforming the audio signal from a time domain to a frequency domain to generate a plurality of frames, each of the plurality of frames comprising frequency information, for a set of frames of the plurality of frames, determining a regularity of expression of the frequency information compared to other sets of frames of the plurality of frames, and determining that the frequency information in the set of frames indicates that a portion of the audio signal corresponding to the set of frames comprises an irregular event;

providing an indication that the portion of the audio signal corresponding to the set of frames comprises the irregular event; and enabling a display of a multimedia event that is synchronized to the input signal based on the irregular event in the input signal.

13. The one or more computer storage media of claim 12, wherein determining the regularity of expression of the frequency information compared to other sets of frames further comprises:

generating a spectrogram from the frequency information in the frequency domain; and removing harmonic structure from the spectrogram to generate an altered spectrogram.

14. The one or more computer storage media of claim 12, wherein the transforming the at least the portion of the audio signal from the time domain to the frequency domain is performed by way of a time-frequency transform.

15. The one or more computer storage media of claim 14, wherein the time-frequency transform is a short-time Fourier transform.

16. The one or more computer storage media of claim 14, wherein the time-frequency transform is a Constant-Q Transform (CQT).

17. The one or more computer storage media of claim 12, further comprising:

generating an SSM from the plurality of frames; and applying a deflation Nonnegative Matrix Factorization (NMF) to the SSM to reduce unwanted noise floor in the SSM.

18. A system for detecting irregularities in audio, the system comprising:

a frequency domain component configured to transform at least a portion of an input signal corresponding to an audio stream from a time domain to a frequency domain to generate a plurality of frames each comprising frequency information;

a processing component configured to process the input signal to identify that a portion of the input signal corresponding to a set of frames of the plurality of frames comprises an irregular event by comparing the frequency information in the set of frames to the frequency information in other sets of frames of the plurality of frames;

a synchronization component configured to automatically synchronize the input signal with a multimedia event based on the identified irregular event; and at least one other component configured to display the multimedia event on a display device and play the synchronized input signal on a speaker device.

19. The system of claim 18, wherein the irregular event is an event that occurs in the portion of the input signal corresponding to the set of frames but that rarely occurs in other portions of the input signal.

20. The system of claim 18, wherein the processing component is further configured to generate an SSM from the plurality of frames.

* * * * *